US006282995B1

(12) United States Patent
Lin

(10) Patent No.: US 6,282,995 B1
(45) Date of Patent: Sep. 4, 2001

(54) PLIER TOOL HAVING QUICKLY ATTACHABLE TOOL MEMBERS

(76) Inventor: Shu Sen Lin, No. 12-2, Gin Chong Lane, Juen Gong Road, Taichung (TW), 406

( * ) Notice: Subject to any disclaimer, the term of this patent is extended or adjusted under 35 U.S.C. 154(b) by 0 days.

(21) Appl. No.: 09/659,070

(22) Filed: Sep. 11, 2000

(51) Int. Cl.[7] ..... B25B 7/02

(52) U.S. Cl. ..... 81/423; 81/385; 7/125; 30/341

(58) Field of Search ..... 81/423, 418, 422, 81/385; 7/125, 132, 133, 134; 30/122, 341, 260

(56) References Cited

U.S. PATENT DOCUMENTS 1,005,661 * 10/1911 Shirt ..... 30/260
3,132,550 * 5/1964 Sion ..... 81/423
4,793,224 12/1988 Huang ..... 81/302
5,327,802 * 7/1994 Yu ..... 81/312
5,546,661 * 8/1996 Yang ..... 30/146
5,826,467 10/1998 Huang ..... 81/302
6,009,583 * 1/2000 Swanstrom, Jr. ..... 7/133

* cited by examiner

*Primary Examiner*—James G. Smith
*Assistant Examiner*—Hadi Shakeri
(74) *Attorney, Agent, or Firm*—Charles E. Baxley

(57) ABSTRACT

A plier or shear tool includes a pair of handles having one end rotatably secured together with a tube and each having a pole. One or more tool members each includes a pair of levers having a middle orifice for receiving the tube and each having an aperture for receiving the poles and for quickly securing the tool members to the handles. A ball is received in the tube, a shaft is received in the tube and has a depression for receiving the ball. A spring may bias the shaft to disengage the depression from the ball and to force the ball to engage with the hub.

5 Claims, 3 Drawing Sheets

PLIER TOOL HAVING QUICKLY ATTACHABLE TOOL MEMBERS

BACKGROUND OF THE INVENTION

1. Field of the Invention

The present invention relates to a plier tool or a shear tool, and more particularly to a plier tool or a shear tool having one or more tool members that may be easily attached onto and disengaged from the tool body and that may be easily replaced with the other tool members.

2. Description of the Prior Art

U.S. Pat. No. 4,793,224 to Huang, and U.S. Pat. No. 5,826,467 to Huang disclose two typical ring plier tools having a tool member, in which the driving directions of the tool member may be changed by securing different portions of the tool member onto the tool body. However, the other plier tool members or shear members may not be changed or attached onto the tool body, and may not be replaced with each other. In addition, the tool member and the tool body are pivotally or rotatably coupled together with a shaft that may be damaged after use.

The present invention has arisen to mitigate and/or obviate the afore-described disadvantages of the conventional plier tools or shear tools.

SUMMARY OF THE INVENTION

The primary objective of the present invention is to provide a plier tool or a shear tool including one or more tool members that may be easily attached onto and disengaged from the tool body and that may be easily replaced with the other tool members.

In accordance with one aspect of the invention, there is provided a tool comprising a tool body including a pair of handles having a first end rotatably secured together with a tube, the handles each including a pole provided thereon, and one or more tool members each including a pair of levers having an orifice formed in a middle portion of the levers for receiving the tube, the levers of the tool member each including a first end having a tool element provided thereon and each including a second end having an aperture formed therein for receiving the poles of the tool body respectively. The tool elements of the tool member may be moved toward and away from each other by the handles. The poles and the tube of the tool body may be easily and quickly engaged into the apertures and the orifice of the levers for easily and quickly securing or disengaging either of the tool members from the tool body.

The tool member includes a hub disposed in the middle portions of the levers and having the orifice formed in the hub for receiving the tube. A securing device is further provided for securing the hub of the tool member to the tube of the tool body and includes a hole formed in the tube, a ball received in the hole of the tube, and a forcing device for forcing the ball to engage with the hub of the tool member and to secure the hub to the tube.

The hub includes a recess formed therein for receiving the ball. The forcing device includes a shaft received in the tube, the shaft includes a depression formed therein for receiving the ball, and the forcing device further includes a device for disengaging the depression of the shaft from the ball.

The disengaging device includes a spring engaged with the shaft for biasing the shaft relative to the tube and to disengage the depression of the shaft from the ball. The tube includes a chamber formed therein for receiving the spring, the shaft includes a head slidably received in the chamber of the tube and engaged with the spring.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
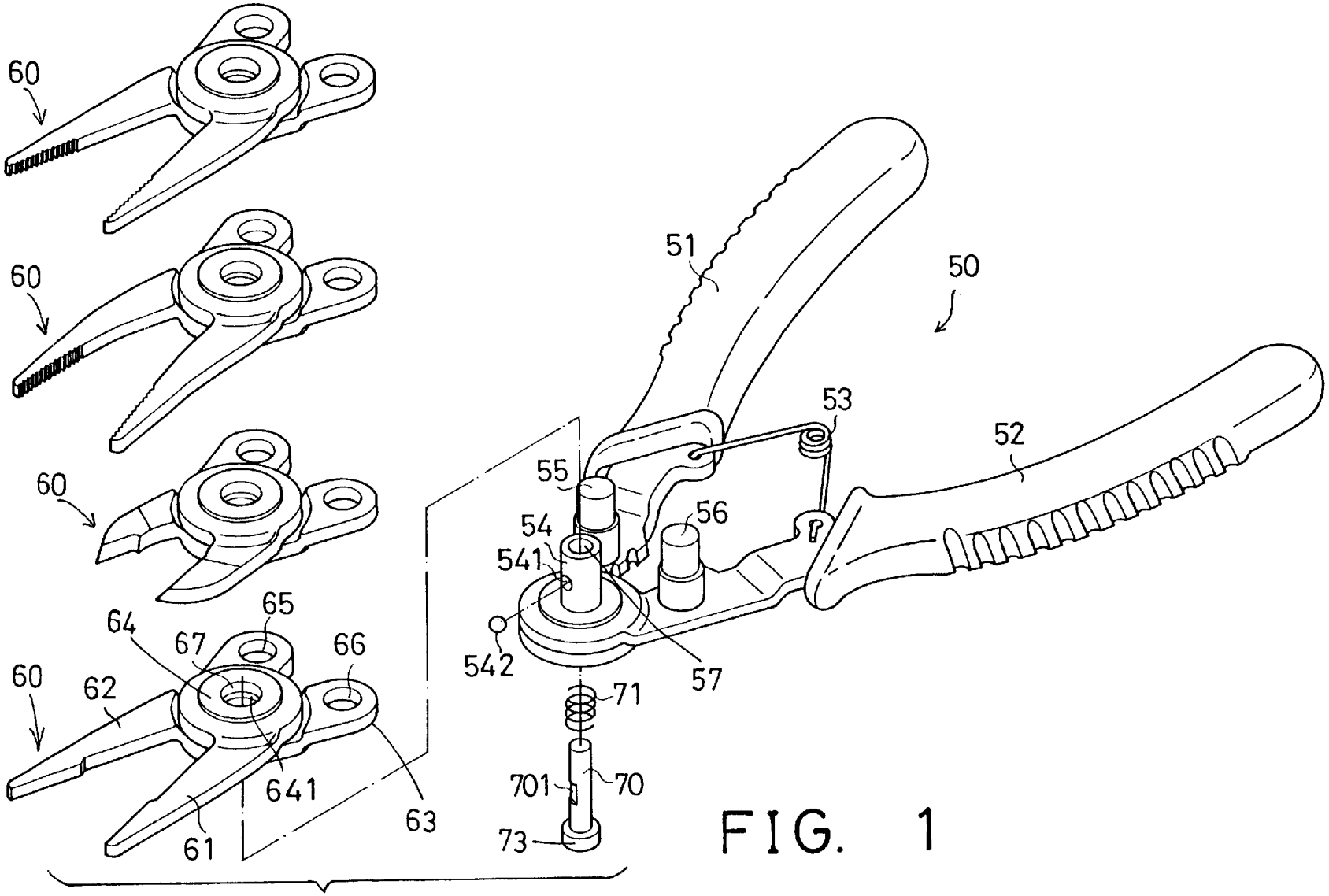
FIG. 1 is an exploded view of a tool in accordance with the present invention.
Figure 2:
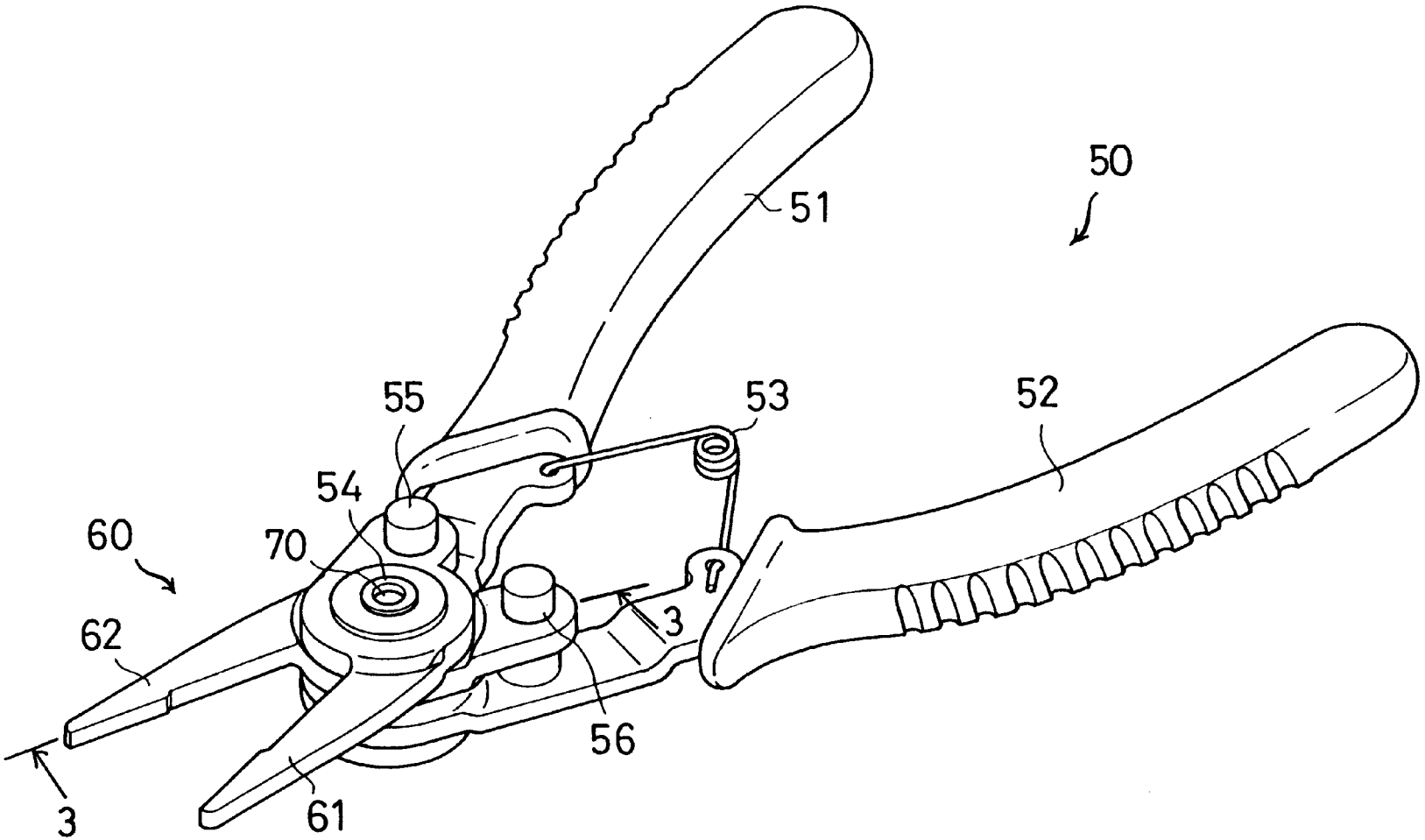
FIG. 2 is a perspective view of the tool.
Figure 3:
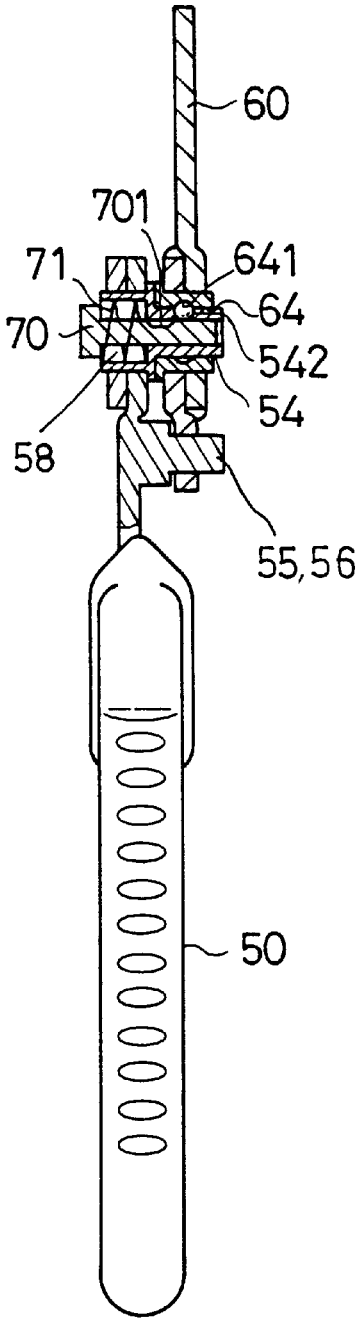
FIG. 3 is a partial cross sectional view taken along lines 3—3 of FIG. 2.

Referring to the drawings, and initially to FIGS. 1–3, a tool in accordance with the present invention may be a plier tool or a shear tool or the like, and comprises a tool body 50 and one or more tool members 60 that may be easily and quickly attached onto and disengaged from the tool body 50. The tool body 50 includes a pair of handles 51, 52 having one end pivotally or rotatably secured together with a tube 54. The tube 54 is extended outward of the handles 51, 52 and includes a bore 57 formed therein and includes an hole 541 laterally formed therein and communicating with the bore 57 thereof for receiving a ball 542 therein. The handles 51, 52 each includes a pole 55, 56 extended therefrom and preferably parallel to the tube 54. A spring 53 is engaged between the handles 51, 52 for biasing the handles 51, 52 away from each other.

The tool members 60 each includes a pair of levers 61 having a middle portion pivotally or rotatably secured together with a hub 64 for allowing the levers 61 to be rotated about the hub 64. The hub 64 includes an orifice 67 formed therein for receiving the tube 54, and includes a recess, or a peripheral recess 641 formed therein and communicating with the orifice 67 thereof for receiving the ball 542 and for securing the tool member 60 to the tool body 50. The levers 61 each includes a tool element 62 formed on one end thereof and each includes an arm 63 provided on the other end thereof. The arms 63 each includes an aperture 65, 66 formed therein for receiving the pole 55, 56 respectively.

Figure 4:
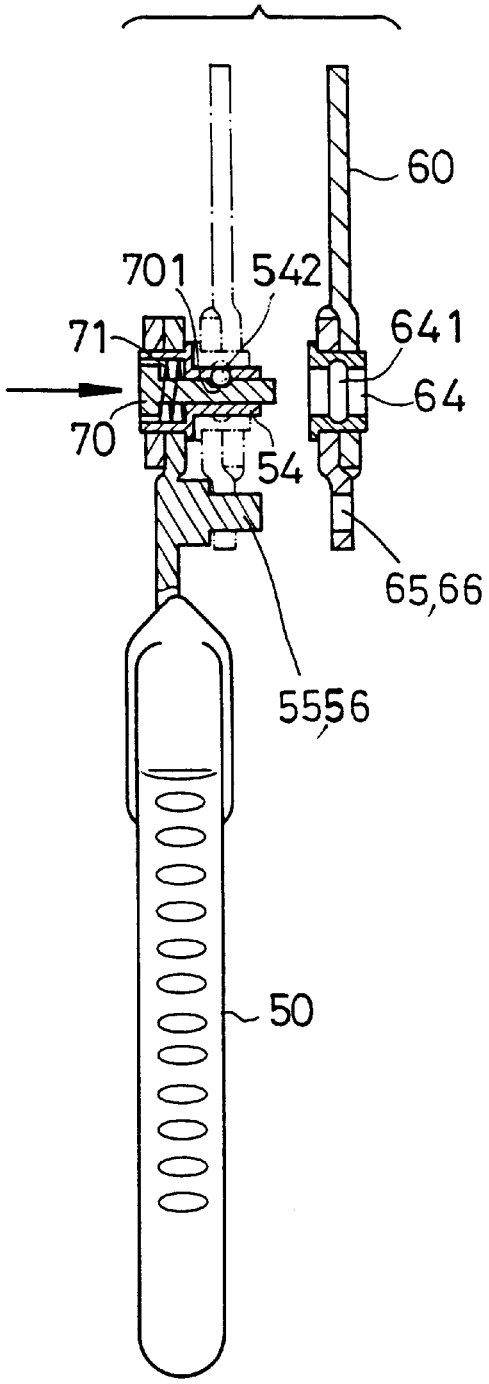
FIG. 4 is a partial cross sectional view similar to FIG. 3, in which the tool member is detached from the tool body.

A fastener shaft 70 is slidably received in the tube 54 and includes a cavity or a curved depression 701 formed therein, particularly formed in the middle portion thereof for receiving the ball 542 (FIG. 4). The tube 54 includes a chamber 58 formed therein (FIG. 3) and having an inner diameter greater than that of the bore 57 of the tube 54 for receiving a head 73 of the shaft 70. A spring 71 is received in the chamber 58 of the tube 54 and is engaged between the tube 54 and the head 71 of the shaft 70 for disengaging the depression 701 of the shaft 70 from the ball 542 and for allowing the shaft 70 to force the ball 542 outward of the tube 54 to engage into the recess 641 of the hub 64 of either of the tool members 60 (FIG. 3). Alternatively, the curved depression 701 of the shaft 70 includes a deeper middle portion for receiving the ball 542 and for allowing the ball 542 to be disengaged from the hub 64 of the tool members 60, and may include two end portions for partially receiving the ball 542 and for partially forcing the ball 542 outward of the tube 54 to engage with the hub 64 of the tool members In operation, as shown in FIG. 4, when the shaft 70 is forced inward of the tube 54 against the spring 71 in order to align the depression 701 of the shaft 70 with the ball 542, the ball 542 may be received in the depression 701 of the shaft 70 and may thus be disengaged from the recess 641 of the hub 64 of either of the tool members 60, such that the tool members 60 may be easily and quickly disengaged from the tool body 50. At this moment, the tube 54 and the poles 55, 56 of the tool body 50 may be easily and quickly engaged into the orifice 67 of the hub 64 and the apertures 65, 66 of either of the tool members 60. When the shaft 70 is released, the spring 71 may bias the shaft 70 to move the depression 701 of the shaft 70 relative to the ball 542 or to disengage the depression 701 of the shaft 70 from the ball 542 and may thus actuate the shaft 70 to force the ball 542 to engage into the recess 641 of the hub 64 of either of the tool members 60, such that the tool members 60 may be easily and quickly attached or secured onto the tool body 50. The tool members 60 may thus be easily and quickly attached onto and disengaged from the tool body 50 and may be easily and quickly replaced with the other tool members. The tool elements 62 of the tool members 60 may thus be moved toward or away from each other by the handles 51, 52 when the handles 51, 52 are forced toward each other by the users and are biased away from each other by the spring 53.

It is to be noted that the tool body 50 provides a tube 54 for pivotally or rotatably securing the handles 51, 52 together and extended outward of the handles 51, 52, and provides a pair of poles 55, 56 provided on the handles 51, 52 respectively. The tube 54 and the poles 55, 56 of the tool body 50 may be easily and quickly engaged into the orifice 67 of the hub 64 and the apertures 65, 66 of either of the tool members 60 for allowing the tool members 60 to be easily and quickly secured onto the tool body 50. None of the prior plier tool bodies provide the tube 54 and the poles 55, 56 for easily and quickly engaging into the tool members. The tool members 60 may be rotatably engaged onto the tube 54 of the tool body 50 instead of being directly engaged onto the shaft 70 such that the shaft 70 will not be damaged by the tool members 60. The shaft 70 is slidably engaged in the tube 54 and may be used for quickly releasing and securing the tool member 60 to the tool body 50. The tube 54 may also be force-fitted in the hub 64 without the fastener shaft 70. The middle portions of the levers 61 of the tool members 60 may include the orifice 67 directly formed therein, without the hub 64, for rotatably receiving the tube 54 and for allowing the levers 61 to be rotatably secured together with the tube 54.

Accordingly, the tool in accordance with the present invention, particularly the plier tool or the shear tool includes one or more tool members that may be easily attached onto and disengaged from the tool body and that may be easily replaced with the other tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a tool body including a pair of handles having a first end rotatably secured together with a tube, said handles each including a pole provided thereon, a first tool member including a pair of levers having an orifice formed in a middle portion of said levers for receiving said tube, said levers of said first tool member each including a first end having a tool element provided thereon and each including a second end having an aperture formed therein for receiving said poles of said tool body respectively, said first tool member including a hub disposed in said middle portions of said levers and having said orifice formed in said hub for receiving said tube, means for securing said hub of said first tool member to said tube of said tool body, said securing means including a hole formed in said tube, a ball received in said hole of said tube, and means for forcing said ball to engage with said hub and to secure said hub to said tube, said tool elements of said first tool member being allowed to be moved toward and away from each other by said handles.

2. The tool according to claim 1, wherein said hub includes a recess formed therein for receiving said ball.

3. The tool according to claim 1, wherein said forcing means includes a shaft received in said tube, said shaft includes a depression formed therein for receiving said ball, and said forcing means further includes means for disengaging said depression of said shaft from said ball.

4. The tool according to claim 3, wherein said disengaging means includes a spring engaged with said shaft for biasing said shaft relative to said tube and to disengage said depression of said shaft from said ball.

5. The tool according to claim 4, wherein said tube includes a chamber formed therein for receiving said spring, said shaft includes a head slidably received in said chamber of said tube and engaged with said spring.

* * * * *